US005128308A

United States Patent [19]

Talvalkar

[11] Patent Number: 5,128,308

[45] Date of Patent: Jul. 7, 1992

[54] THERMAL TRANSFER RIBBON

[75] Inventor: Shashi G. Talvalkar, Kettering, Ohio

[73] Assignee: NCR Corporation, Dayton, Ohio

[21] Appl. No.: 458,273

[22] Filed: Dec. 21, 1989

[51] Int. Cl.[5] ..... B41M 5/30; B41M 5/40

[52] U.S. Cl. ..... 503/201; 427/152; 503/200; 503/226

[58] Field of Search ..... 427/150-152; 428/195, 484, 488.1, 488.4, 913, 914; 503/200, 214, 225, 226, 201, 216, 217

[56] References Cited

U.S. PATENT DOCUMENTS

| | | | |
|---|---|---|---|
| 3,663,278 | 5/1972 | Blose et al. | 117/234 |
| 4,315,643 | 2/1982 | Tokunaga et al. | 282/27.5 |
| 4,463,034 | 7/1984 | Tokunaga et al. | 427/256 |
| 4,523,207 | 6/1985 | Lewis et al. | 346/214 |
| 4,628,000 | 12/1986 | Talvalkar et al. | 428/341 |
| 4,687,701 | 8/1987 | Knirsch et al. | 428/216 |
| 4,698,268 | 10/1987 | Ueyama | 428/484 |
| 4,777,079 | 10/1988 | Nagamoto et al. | 428/212 |
| 4,778,729 | 10/1988 | Mizobuchi | 428/484 |

*Primary Examiner*—Bruce H. Hess
*Attorney, Agent, or Firm*—George J. Muckenthaler

[57] ABSTRACT

A thermal transfer ribbon has a substrate, an undercoating which contains thermal reactive materials and leuco dyes, and a thermal transfer coating applied on the undercoating and which contains a mixture of a wax emulsion and a sensible material, the undercoating assiting the transfer of color images of an improved intensity and sharpness to a receiving medium upon the application of heat to the ribbon. The invention also covers incorporation of the leuco dye and a reactant in the functional coating to intensify the transferred image, with or without the presence of sensible materials such as iron oxide or fluroescent dye, to improve the sharpness and the scratch and smear resistance of the transferred image. An alternative to the two coatings is a single coating which includes pigments with sensing characteristics, thermal reactive material, and transfer agents to obtain an improved intensity image.

13 Claims, 2 Drawing Sheets

THERMAL TRANSFER RIBBON

BACKGROUND OF THE INVENTION

In the printing field, the impact type printer has been the predominant apparatus for providing increased throughput of printed information. The impact printers have included the dot matrix type wherein individual print wires are driven from a home position to a printing position by individual and separate drivers. The impact printers also have included the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine readable in a subsequent operation. One of the known encoding systems is MICR (Magnetic Ink Character Recognition) utilizing the manner of operation as just mentioned.

While the impact printing method has dominated the industry, one disadvantage of this type of printing is the noise level which is attained during printing operation. Many efforts have been made to reduce the high noise levels by use of sound absorbing or cushioning materials or by isolating the printing apparatus.

More recently, the advent of thermal printing which effectively and significantly reduces the noise levels has brought about the requirements for heating of extremely precise areas of the record media by use of relatively low energy and thin film resistors. The intense heating of the localized areas causes transfer of ink from a ribbon onto the paper or like receiving substrate. Alternatively, the paper may be of the thermal type which includes materials that are responsive to the generated heat.

The use of thermal transfer printing, especially when performing a subsequent sorting operation, can result in smearing or smudging adjacent the printed symbols or digits on the receiving substrate. This smearing can make character recognition, such as OCR (Optical Character Recognition) or MICR (Magnetic Ink Character Recognition), difficult and sometimes impossible. Additionally, the surface of the receiving substrate and the printed symbols or digits are subject to scratching which can result in blurred images and incorrect reading of the characters.

The present invention provides a thermal transfer medium in the preferred form of a ribbon which eliminates or substantially reduces smearing or smudging and scratching across or adjacent the printed digits or symbols during sorting or other operations.

Representative documentation in the area of nonimpact printing includes U.S. Pat. No. 3,663,278, issued to J. H. Blose et al. on May 16, 1972, which discloses a thermal transfer medium having a coating composition of cellulosic polymer, thermoplastic resin, plasticizer and a sensible dye or oxide pigment material.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Wirnowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to F. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama et al. on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

And, U.S. Pat. No. 4,778,729, issued to A. Mizobuchi on Oct. 18, 1988, discloses a heat transfer sheet comprising a hot melt ink layer on one surface of a film and a filling layer laminated on the ink layer.

SUMMARY OF THE INVENTION

The present invention relates to nonimpact printing. More particularly, the invention provides a coating formulation or composition and a thermal ribbon or transfer medium for use in imaging or encoding characters on paper or like record media documents which enable machine, or human, or reflectance reading of the imaged or encoded characters. The thermal transfer ribbon enables printing in a quiet and efficient manner and makes use of the advantages of thermal printing on documents with a signal inducible ink.

Since the transferred digits or symbols which are created by means of thermal transfer technology, in effect, "sit" on the surface of the paper or media, a smearing of the ink of the digits or symbols or a scratching of the surface is a major concern in the course of the document sorting operation.

In accordance with the present invention, there is provided a thermal transfer ribbon comprising a substrate, a first coating on said substrate and containing essential ingredients which are water based and are thermally reactive for creating color images, and a second coating on said first coating and containing essential ingredients which are solvent based, said first coating assisting said second coating in transferring said color images onto an image receiving medium upon the application of heat to said thermal transfer ribbon.

The ribbon comprises a thin, smooth substrate such as tissue-type paper or polyester-type plastic on which is applied an undercoating and a thermal functional coating. The undercoating is water based and is applied directly onto the substrate and serves as an assisting layer for transferring the thermal functional coating onto a receiving substrate. The functional coating is solvent based and comprises a thermal transfer layer or coating which generally includes a wax mixture dispersed in a binding mix of an ethylene copolymer or a hydrocarbon resin to form the wax emulsion. The hydrocarbon resin and the solids of the wax emulsion are mixed or dispersed into solution with oxide and coloring pigments in an attritor or other conventional dispersing equipment. The coloring pigments, dyes or like sensible materials may include colors such as magenta, cyan, yellow or black and such pigments may also include a magnetic (iron) oxide. The thermal transfer coating is then applied to the undercoating on the substrate by well-known or conventional coating techniques.

The undercoating is applied to the substrate and the functional or thermal transfer coating is applied to the undercoating as a two-layer process. The undercoating layer is provided to substantially reduce or eliminate image smearing, smudging or scratching of a transferred and printed image when using a nonmagnetic or a magnetic thermal transfer ribbon. The undercoating is thermally reactive and is water based and comprises a mixture of cellulose, latex, sucrose benzoate, a phenolic type of anti-oxident or a phenolic resin, and a thermochromic dye. The thermal functional coating is solvent based and comprises a wax emulsion of hydrocarbon, paraffin and carnauba waxes and ethylene vinyl acetate copolymer. An iron oxide is added to the wax emulsion and the two coatings are applied on the substrate in the conventional coating manner as mentioned above.

A second embodiment of the invention provides a single layer or coating which contains both the thermal reactive material and the pigment or dye material.

In view of the above discussion, a principal object of the present invention is to provide a ribbon including a thermal-responsive coating thereon.

Another object of the present invention is to provide a thermal transfer ribbon substrate including a coating thereon for use in imaging or encoding operations.

An additional object of the present invention is to provide a coating on a ribbon having ingredients in the coating which are responsive to heat for transferring a portion of the coating to paper or like record media.

A further object of the present invention is to provide a coating on a ribbon substrate, which coating includes a pigment material and a wax emulsion dispersed in a binder mix and which is responsive to heat for transferring the coating in precise printing manner to paper or like record media.

Still another object of the present invention is to provide a thermally-activated coating on a ribbon that is transferred from the ribbon onto the paper or document in an imaging operation in printing manner at precise positions and during the time when the thermal elements are activated to produce a well-defined and precise or sharp image.

Still an additional object of the present invention is to provide an undercoat layer and a thermal transfer layer consisting essentially of a wax emulsion and wherein the undercoat layer is provided to prevent smearing or scratching of printed images or other marks.

Still a further object of the present invention is to provide a two layer process which includes the preparation of an undercoating and a specific wax emulsion for use in a sorting operation.

Still another object of the present invention is to provide a heat sensitive, thermal transfer ribbon created by use of a water based undercoating or layer that is applied on a substrate, and a solvent based thermal functional coating wherein the two coatings are nonintegral with each other and the transferred images from the coating arrangement resist smearing, smudging or scratching of the transferred images or marks.

Still an additional object of the present invention is to provide a thermal transfer ribbon by combining direct thermal reactive materials of the phenolic resin type with thermochromic dyes which upon heating create various or different color images.

Still another object of the present invention is to provide an undercoat layer which is capable of forming a color upon the application of heat by reason of the presence of a leuco dye and a reactant and also is capable of assisting the transfer of a color image onto a receiving substrate.

Still a further object of the present invention is to provide a thermal transfer ribbon using thermal reactive ingredients which can be dispersed either in the undercoat layer or in the thermal transfer layer to provide assistance in creating and transferring images of improved intensity and which images are resistant to smearing and scratching of the transferred images.

Additional advantages and features of the present invention will become apparent and fully understood from a reading of the following description taken together with the annexed drawing.

DESCRIPTION OF THE PREFERRED EMBODIMENT

Figure 1:
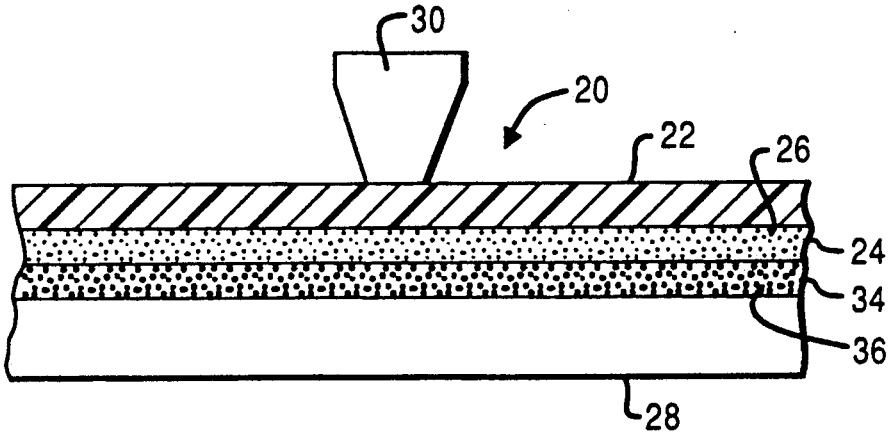
FIG. 1 illustrates a receiving document and a thermal element operating with a ribbon base or substrate having an undercoating and a thermal functional coating thereon incorporating the ingredients as disclosed in the present invention.
Figure 2:
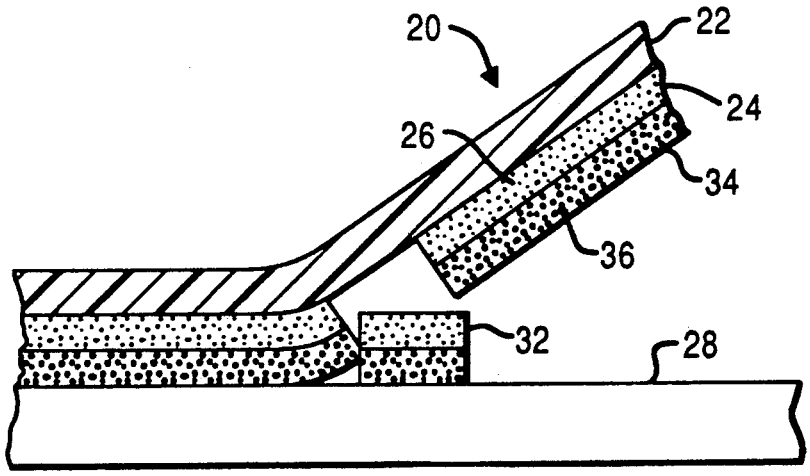
FIG. 2 shows the receiving document with a portion of the two coatings transferred in form of a digit, symbol or other mark onto the receiving document.

The transfer ribbon 20, as illustrated in FIGS. 1 and 2, comprises a base or substrate 22 of thin, smooth, tissue-type paper or polyester-type plastic or like material having an undercoating or layer 24 on the substrate. The undercoating 24 contains thermal reactive material 26 in the form of particles thereof combined with pigment or dye particles. The ribbon 20 also has a functional or thermal-sensitive coating 34 which is thermally activated, which is assisted in image transfer by the thermal reactive materials in the layer 24, and includes either magnetic or nonmagnetic pigment or particles 36 as an ingredient therein for use in imaging or encoding operations to enable machine reading, or human reading, or reflectance reading, of characters or other marks. Each character or mark that is imaged on a receiving paper document 28 or like record media produces a unique pattern or image 32 that is recognized and read by the reader. In the case of thermal transfer ribbons relying solely on the nonmagnetic thermal printing concept, the pigment or particles 36 include coloring materials such as pigments, fillers and dyes. In the case of ribbons relying on the magnetic thermal printing concept, the pigment or particles 36 include magnetic oxides or like sensible materials.

As alluded to above, it is noted that the use of a thermal printer having a print head element, as 30, substantially reduces noise levels in printing operation and provides reliability in imaging or encoding of paper or like documents 28. The thermal transfer ribbon 20 provides the advantages of thermal printing while encoding or imaging the document 28 with a magnetic or with a nonmagnetic signal inducible ink. When the heating elements 30 of a thermal print head are activated, the imaging or encoding operation requires that the pigment or particles of material 36 in the functional coating 34 on the coated ribbon 20 be transferred from the ribbon to the document 28 in manner and form to produce precisely defined characters 32 on the document for recognition by the reader. In the case of nonmagnetic thermal printing, the imaging or encoding material 36 is transferred to the document 28 to produce precisely defined characters 32 for recognition and for machine, human, or reflectance reading thereof.

In the case of magnetic thermal printing, the thermal sensitive coating 34 includes the magnetic pigment or particles 36 for use in imaging or encoding operations to enable optical, human, or machine reading of the characters. The magnetic thermal transfer ribbon 20 provides the advantages of thermal printing while encoding or imaging the document 28 with a magnetic signal inducible ink.

The thermal transfer ribbon of the present invention is produced as a two-layer process wherein the first coating 24 adjacent the substrate 22 is an undercoating or layer and the second coating 34 is a thermal functional coating or layer and includes a specific wax emulsion or formulation.

The coating or layer 24 is provided directly on the substrate 22 as an undercoating, and the thermal transfer coating 34 is provided on the side away or distal from the ribbon substrate 22 as an overcoating, as seen in FIGS. 1 and 2. The coating or layer 24 exhibits the following characteristics, namely, the coating must be resistant to normal operational parameters and must not inhibit transfer of the thermal-sensitive material 36 in the coating 34 at normal print head energy, and the coating 24 must allow a bond of the thermal-sensitive material 36 in the coating 34 onto the paper 28 upon transfer of such material.

The thermal functional coating 34 includes wax emulsion ingredients and pigment ingredients. The magnetically active thermal transfer coating or functional coating 34 is prepared in a two step process. A wax adhesive emulsion of about 28% solids using hydrocarbon wax, paraffin wax, carnauba wax, and an ethylene/vinyl acetate copolymer or a polymerized terpolymer is prepared as a first step of the process in a mineral spirit or like solvent based formulation. The second step of the process is the preparation of a dispersion or the functional coating 34 using the above wax emulsion or mixture and adding an iron oxide and a polytetrafluoroethylene (PTFE) wax. The dispersion or functional coating 34 is prepared by mixing the ingredients of the above wax emulsion and the iron oxide and PTFE wax in a ball mill or like conventional grinding equipment. The dispersion consists of about 43% solids.

A preferred wax emulsion or formulation to satisfy the requirements of the thermal functional coating 34 includes the ingredients in appropriate amounts as set forth in Tables 1 and 2 of Example I.

EXAMPLE I

TABLE 1

| Wax Emulsion Ingredient | % Dry | Batch Dry | Batch Wet | % Dry Range |
|---|---|---|---|---|
| Paraffin 162 Wax | 25.0 | 43.00 | 43.00 | 10–40% |
| WB-17 Wax | 6.0 | 10.32 | 10.32 | 5–20% |
| Carnauba #3 Wax | 15.5 | 26.66 | 26.66 | 10–30% |
| Elvax 4310 | 1.0 | 1.72 | 1.72 | .5–3% |
| Elvax 40W | 2.5 | 4.30 | 4.30 | 2–7% |
| | 50.0 | 86.00 | 86.00 | |
| Mineral Spirits | | | 228.00 | |
| Total Wax Emulsion | | | 314.00 | |

TABLE 2

| Ingredient | % Dry | Batch Dry | Batch Wet | % Dry Range |
|---|---|---|---|---|
| Wax Emulsion (from above) | 50.0 | 86.00 | 314.00 | 35–65% |
| Iron Oxide | 49.8 | 85.65 | 85.65 | 35–65% |
| SST-3 Wax | 0.2 | 0.35 | 0.35 | .1–5% |
| | 100.00 | 172.00 | 400.00 | |

All quantities in the above tables are in grams. The nonvolatile or solid material in the above formulation are controlled and kept at about 43%, and it is here noted that Lacolene, or VM and P Naptha, can be substituted in place of the mineral spirits. The wax adhesive emulsion is prepared by mixing the above ingredients and heating the mixture to approximately 195° F. for a period of about 15 minutes. After all the ingredients of the was emulsion have dissolved, the wax emulsion is allowed to cool to about 120° F. and is transferred to conventional grinding or dispersing equipment. The iron oxide of Table 2 is then added to the warm emulsion. The dispersion equipment such as a ball mill, a shot mill, a sand mill, or an attritor is used and the ingredients are ground for a period of approximately 30 minutes, or for a sufficient period of time to provide a uniform fine (3–5 microns size) dispersion.

The nonvolatile materials of the thermal transfer coating 34 are controlled or kept at approximately 35% for proper viscosity. In a separate process operation comprising the preparation of the undercoating or layer 24, the following ingredients in appropriate amounts, as set forth in Table 3, are ground together to provide a fine particle size of 3 to 5 microns and applied directly to the substrate 22.

TABLE 3

| Undercoating Ingredient | % Dry | Batch Dry | Batch Wet | % Dry Range |
|---|---|---|---|---|
| CMC @ 2% | 2.0 | 3.7 | 180.0 | 1–3% |
| CVL | 4.0 | 7.2 | 7.2 | 2–10% |
| Latex @ 42% | 12.0 | 21.6 | 51.4 | 5–16% |
| Sucrose Benzoate | 40.25 | 72.4 | 72.4 | 5–50% |
| HRJ Resin (Dry) | 40.25 | 72.4 | 72.4 | 10–50% |
| Surfynol PC | 1.0 | 1.8 | 1.8 | .5–1% |
| Nopco NDW | 0.5 | 0.9 | 0.9 | .1–1.1% |
| Water | — | — | 513.9 | |

TABLE 3-continued

| Undercoating Ingredient | % Dry | Batch Dry | Batch Wet | % Dry Range |
|---|---|---|---|---|
| | 100.00 | 180.0 | 900.0 | |

Another example of the undercoating 24 is set forth in Table 4 wherein the following ingredients are provided in appropriate amounts and are ground together to provide a fine particle size of 3 to 5 microns and applied directly to the substrate 22.

TABLE 4

| Undercoating Ingredient | % Dry | Batch Dry | Batch Wet | % Dry Range |
|---|---|---|---|---|
| CMC @ 2% | 2.0 | 3.6 | 180.0 | 1-3% |
| CVL | 4.0 | 7.2 | 7.2 | 2-10% |
| Latex @ 42% | 12.0 | 21.6 | 51.4 | 5-16% |
| Armoslip 18 | 5.5 | 9.9 | 9.9 | 5-30% |
| Sucrose Benzoate | 37.5 | 67.5 | 67.5 | 5-50% |
| HRJ Resin 4002 (54% Solids) | 37.5 | 67.5 | 125.0 | 10-50% |
| Surfynol PC | 1.0 | 1.8 | 1.8 | .5-1% |
| Nopco NDW | 0.5 | 0.9 | 0.9 | .1-1.1% |
| Water | — | — | 456.3 | |
| | 100.0 | 180.0 | 900.0 | |

All quantities in Table 3 and in Table 4 are in grams. It is to be noted that the percentage of solids for the 900 gram batch of ingredients of Table 3 and of Table 4 is about 20%.

The undercoat layer 24 is applied to the substrate 22 by means of conventional coating techniques such as a Meyer rod or like wire-wound doctor bar set up on a typical coating machine to provide a coating weight of 1.5 and 2.0 grams per square meter on the desired substrate. As stated above, the undercoat layer 24 is made up of approximately 20% nonvolatile material and is maintained at a desired temperature (90° to 120° F.) and viscosity throughout the coating process. The functional coating or dispersion 34 is applied over the undercoating 24 to provide a coating weight of 7.5 to 8 grams per square meter. After the undercoat layer 24 is applied to the substrate 22 and dried, the thermal functional coating 34 is applied to the layer 24 and dried. The temperature of the dryer is maintained in the range between 120° F. and 160° F. to ensure good drying and adherence of the undercoat layer 24 to the substrate 22 and of the thermal coating 34 to the undercoat layer 24 in making the transfer ribbon 20. The above-mentioned coating weight, as applied by the Meyer rod onto a preferred 9-12 microns thick substrate, overall translates to a total thickness of 12-15 microns The layer 24 and the coating 34 can be fully transferred onto the receiving substrate 28 in the range between 130° F. and 190° F. by changing the ranges of the waxes used in the first step of the process.

The practice of the invention provides that, upon transfer of the image or character material 36 of the coating 34 onto the paper 28 in a printing operation, the acrylic, water based layer or undercoat 24 remains nonintegral with the solvent based coating 34 and "sits" on top of the transferred image, as seen in FIG. 2. This arrangement and structure of the layer 24 and the coating 34 provides significantly higher resistance to smearing or scratching in encoding and sorting operations. In addition to the acrylic ingredients, incorporation of the lower melting temperature, phenolic resins further improves the smear resistance of the transferred image. Further, the sucrose benzoate enhances the image quality and improves the scratch and smear resistance of the transferred image.

The thermal transfer ribbon of the present invention can also be created as a single layer process by adjusting the percentages of the transfer agents and incorporating pigments with desired sensing characteristics or coloring agents for the necessary optical contrast.

Figure 3:
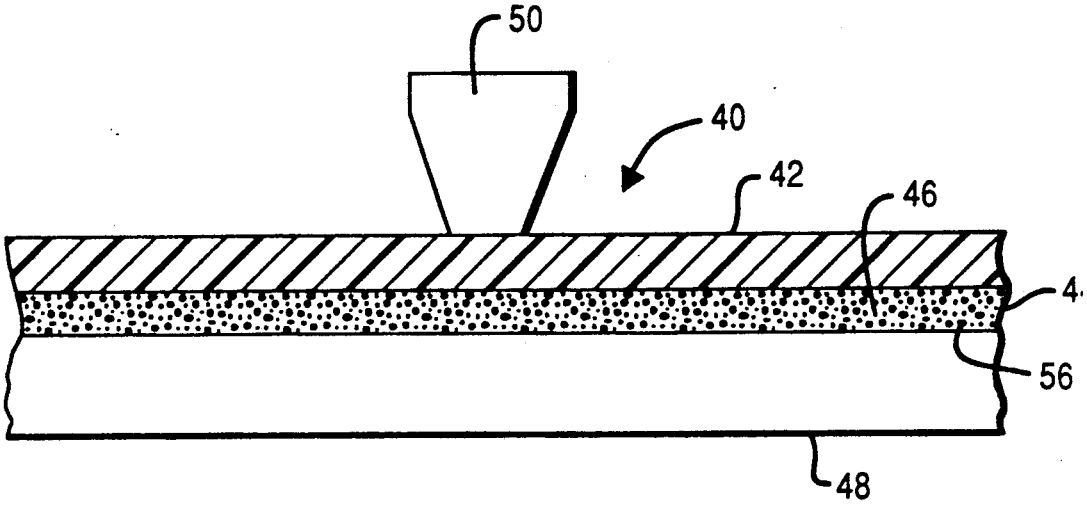
FIG. 3 illustrates a second embodiment of the invention with a single layer or coating incorporating the ingredients as disclosed in the present invention.
Figure 4:
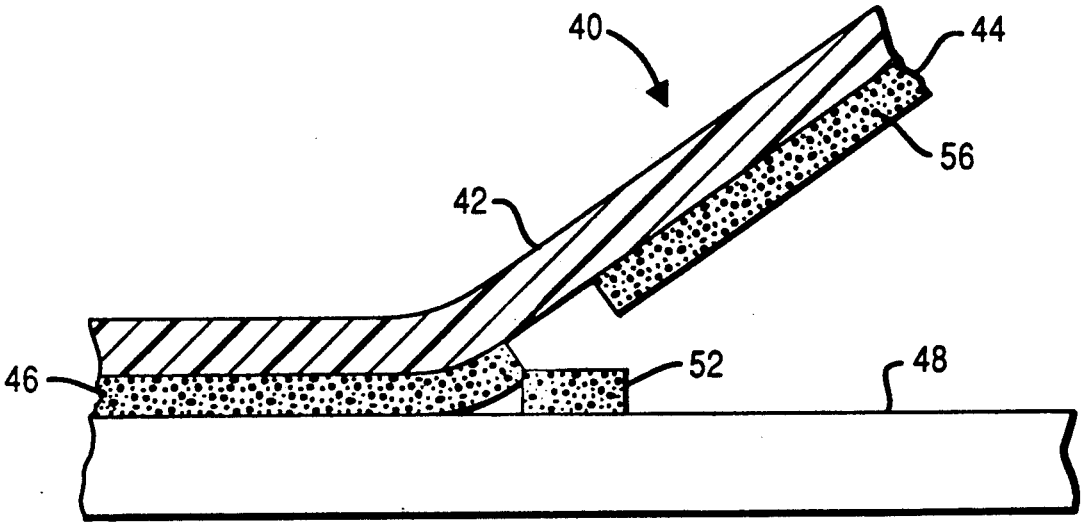
FIG. 4 shows the receiving document with a portion of the coating transferred in the form of a digit, symbol or other mark onto the receiving document.

The transfer ribbon 40, as illustrated in FIGS. 3 and 4, comprises a base or substrate 42 of thin, smooth tissue-type paper or polyester-type plastic or like material having a coating or layer 44 on the substrate. The coating 44 contains particles of direct thermal reactive material, such as phenolic resin, combined with particles of pigment or dye, identified as 46, and the coating 44 also contains particles of thermal transfer material, identified as 56.

The thermal transfer material may include either magnetic or nonmagnetic pigment or particles 56 as an ingredient therein for use in imaging or encoding operations to enable machine reading, or human reading, or reflectance reading, of characters or other marks. Each character or mark that is imaged on a receiving paper document 48 or like record media by means of a thermal print element 50 produces a unique pattern or image 52 that is recognized and read by the reader. In the case of thermal transfer ribbons relying solely on the nonmagnetic thermal printing concept, the pigment or particles 56 include coloring materials such as pigments, fillers and dyes. In the case of ribbons relying on the magnetic thermal printing concept, the pigment or particles 56 include magnetic oxides or like sensible materials.

One formulation to satisfy the requirements of the single layer concept of the present invention includes the ingredients in appropriate amounts as set forth in Example II. Since the CVL-Phenol combination helps in improving the transfer quality and the intensity of the transferred image, the following example sets out the ingredients for a single pass, water base, thermal transfer coating.

EXAMPLE II

| Ingredient | % Dry | Batch Dry | Batch Wet | % Dry Range |
|---|---|---|---|---|
| Armoslip 18 | 27.3 | 66.9 | 66.9 | 8-30% |
| Latex 1052 | 14.0 | 34.3 | 81.7 | 5-15% |
| Phenolic Resin 4002 @ 54% | 10.0 | 24.5 | 45.4 | 5-25% |
| CMC @ 2% | 2.0 | 4.9 | 245.0 | 2-5% |
| CVL | 2.0 | 4.9 | 4.9 | 2-10% |
| Sucrose Benzoate | 5.0 | 12.2 | 12.2 | 5-30% |
| SST-3 | 0.2 | 0.5 | 0.5 | .1-1% |
| Surfynol PC | 1.0 | 2.5 | 2.5 | .5-1% |
| Nopco NDW | 0.5 | 1.2 | 1.2 | .1-1% |
| BASF Oxide | 38.0 | 93.1 | 93.1 | 35-55% |
| Water | — | — | 146.6 | |
| | 100.0 | 245.0 | 700.0 | |

The nonvolatile or solid materials in the above formulation are controlled and kept at about 35%. The mixture of ingredients is then ground in the dispersion equipment for a period of approximately 45 minutes, or for a sufficient period of time to provide a uniformly fine (3-5 microns size) dispersion. In the grinding process, the temperature of the dispersion is maintained at about 50° F. by circulating cooling water in the jacket of the particle size reduction apparatus.

Another formulation to satisfy the requirements of the single layer concept of the present invention includes the ingredients in appropriate amounts as set forth in Example III.

EXAMPLE III

| Ingredient | % Dry | Batch Dry | Batch Wet | % Dry Range |
|---|---|---|---|---|
| Latex 1052 | 12.0 | 26.9 | 64.0 | 5-15% |
| Behenyl Alcohol | 16.0 | 35.8 | 35.8 | 8-30% |
| Armoslip 18 | 17.0 | 38.1 | 38.1 | 8-30% |
| Sucrose Benzoate | 5.0 | 11.2 | 11.2 | 5-30% |
| S-205 | 2.0 | 4.5 | 4.5 | 2-10% |
| BASF Oxide | 38.0 | 85.1 | 85.1 | 35-55% |
| Surfynol PC | 0.5 | 1.2 | 1.2 | .5-1% |
| Nopco NDW | 0.5 | 1.2 | 1.2 | .1-1% |
| HRJ Resin 4002 @ 54% Solids | 9.0 | 20.2 | 37.3 | 5-25% |
| Water | — | — | 521.8 | |
| | 100.0 | 224.0 | 800.0 | |

The nonvolatile or solid materials in the above formulation are controlled and kept at about 28%. The behenyl alcohol was added to the formulation for the purpose of reducing the transfer temperature.

The above example shows incorporation of S-205 leuco dye which produces an intense black color upon reacting with the HRJ 4002 phenolic resin. Several other reactive dyes are commercially available to create a wide spectrum of "reactive colors" with the phenolic resin. Use of such leuco dyes in the 2 to 10% range is especially important since the reactive colors show more resistance to offsetting and smudging and specifically exhibit improved scratch resistance in the absence of external colored pigments. The following table summarizes the "color" with various leuco dyes when such dyes are thermally reacted with the phenolic resin.

| Leuco Dye | Color |
|---|---|
| CVL | Blue |
| OR-55 | Orange |
| DEBN | Red |
| 506 | Blue-Violet |
| ATP | Green |
| S-205 | Black |

The above leuco dyes can be obtained commercially from Yamade Chemical.

Paraffin 162 wax is a mixture of solid hydrocarbons chiefly of the methane series derived from the paraffin distillate portion of crude petroleum and is soluble in benzene, ligroine, alcohol, chloroform, turpentine, carbon disulfide and olive oil. WB-17 is an oxidized, isocyanated hydrocarbon wax. Carnauba #3 is a hard, amorphous wax derived by exudation from leaves of the wax palm and is soluble in ether, boiling alcohol and alkalies. Elvax 40W is an ethylene vinyl acetate copolymer. Elvax 4310 is a terpolymer that is polymerized from ethylene vinyl acetate and acid and is used as a binding material. The iron oxide is a bluish-black amorphous powder in form and magnetic in function, is insoluble in water, alcohol and ether, and is used as a pigment or sensible material. SST-3 is a polytetrafluoroethylene (PTFE) wax, powdery in form. Armoslip 18 is an amide wax.

CMC is a sodium carboxymethyl cellulose, synthetic cellulose gum, or sodium cellulose glycolate. Latex at 42% is a milk like fluid in the form of particles suspended in water. More specifically, the latex at 42% is identified as Formula No. EC-1052, a water-based acrylic primer used as an agent for enhancing ink adhesion to the substrate. Sucrose benzoate is an adhesive plasticizer-modifier and is used as a transfer agent that is compatible with waxes and copolymers. HRJ Resin is a phenolic resin either in the form of dry powder or as an emulsion in water and is available in the range of 50 to 55% solids and is used as a direct thermal reactive material. Surfynol PC is an organic surface-active material used as a wetting agent. Nopco NDW is a defoamer of the glycol group. CVL is crystal violet lactone from the group of Leuco dyes (Triphenyl Methane Series) or Methyl fluoran which create a dark blue color upon reacting with phenolic resin. Behenyl alcohol is a saturated fatty alcohol used as a temperature modifier.

The substrate or base 22, which may be 30–40 gauge capacitor tissue, as manufactured by Glatz, or 14–35 gauge polyester film, as manufactured by duPont under the trademark Mylar, should have a high tensile strength to provide for ease in handling and coating of the substrate. Additionally, the substrate should have properties of minimum thickness and low heat resistance to prolong the life of the heating elements 30 of the thermal print head by reason of reduced print head actuating energies.

The present invention combines thermal transfer technology and direct thermal printing technology to improve the transfer capabilities and to provide a transferred image of high intensity. In this regard, the direct thermal reactive maerials such as phenolic resins with CVL, N-102 and Copychem dyes or like Leuco dyes are combined with either the nonmagnetic or the magnetic thermal transfer materials to obtain the high intensity print. Further, it is noted that the reaction of the CVL and other dyes with phenolic resins upon heating by thermal elements assists in the transfer of the material and provides a higher intensity print with improved resistance to scratch and smear.

The availability of the various ingredients used in the present invention is provided by the following list of companies.

| Material | Supplier |
|---|---|
| WB-17 Wax | Bareco |
| Paraffin 162 Wax | Boler |
| Carnauba #3 Wax | Baldini & Co., Inc. |
| Elvax 40W Wax | E. I. duPont |
| Elvax 4310 Wax | E. I. duPont |
| Iron Oxide | BASF |
| PTFE Wax | Diamond Shamrock |
| Sucrose Benzoate | Velsicol |
| CMC @ 2% | Hercules |
| Latex @ 42% | Environmental Ink |
| Armoslip 18 | Armak Co. |
| HRJ Resin | Schenectady Chemical |
| Surfynol PC | Airco Chemical |
| Nopco NDW | Nopco Chemical Co. |
| Behenyl Alcohol | Falleck Chemical |
| Leuco Dyes | Hilton - Davis or BASF or Ciba-Geigy or Yamada Chemical |

The present invention combines direct thermal reactive material such as phenolic resins and dyes with thermal transfer material to produce images of high intensity.

It is thus seen that herein shown and described is a thermal transfer ribbon for use in thermal printing operations which includes an undercoat layer and a thermal responsive coating on one surface thereof. The coated ribbon enables transfer of coating material onto documents or like record media during the printing operation to form digits or symbols or other marks thereon in an imaging or in an encoding nature, permitting machine or other reading of the characters. In the coating material transfer process, the undercoat layer is transferred over the thermal responsive coating to resist smearing, smudging or scratching of the transferred images or other marks. A modification of the thermal transfer ribbon utilizes a single coating which includes thermal reactive material and thermal transfer material. The present invention enables the accomplishment of the objects and advantages mentioned above, and while a preferred embodiment and a modification have been disclosed herein, other variations thereof may occur to those skilled in the art. It is contemplated that all such variations and any modifications not departing from the spirit and scope of the invention hereof are to be construed in accordance with the following claims.

What is claimed is:

1. A thermal transfer ribbon comprising a substrate, a first coating on said substrate and containing essential ingredients which are water based and are thermally reactive for creating color images, and a second coating distal from said substrate and on said first coating and nonintegral therewith and containing essential ingredients which are solvent based and are thermally active for transferring said color images created in said first coating, the ingredients in said first coating comprising a leuco dye and a phenolic resin reacting with each other in the creating of said color images by thermal reaction of said leuco dye and said phenolic resin and such thermal reaction assisting the ingredients in said second coating in transferring said color images onto an image receiving medium upon the application of heat to said ribbon.

2. The thermal transfer ribbon of claim 1 wherein the first coating is an undercoating applied directly on said substrate and contains the phenolic resin and the leuco dye for assisting the ingredients in said second coating in the transfer of said color images thereby improving the intensity of the transferred images.

3. The thermal transfer ribbon of claim 1 wherein the first coating is an undercoating applied directly on said substrate and contains the phenolic resin, the leuco dye and sucrose benzoate for assisting the ingredients in said second coating in the transfer of said color images thereby improving the intensity of the transferred images.

4. The thermal transfer ribbon of claim 1 wherein the second coating is a thermal transfer coating and contains a wax mixture of ethylene vinyl acetate copolymer, paraffin wax and carnauba wax, and iron oxide is dispersed in said wax mixture which is applied on said first coating.

5. The thermal transfer ribbon of claim 4 wherein the thermal transfer coating is the combination of a wax emulsion which contains as essential ingredients about 0.5 to 3% acidic terpolymer, about 2 to 7% ethylene vinyl acetate copolymer, about 10 to 40% paraffin wax, about 10 to 30% carnauba wax, about 5 to 20% hydrocarbon wax, and 35 to 65% iron oxide added to said wax emulsion to provide for magnetic reading of said color images, the percentages of said ingredients being all by dry weight.

6. The thermal transfer ribbon of claim 5 wherein the thermal functional coating also contains about 0.1 to 5% polytetrafluoroethylene wax, by dry weight.

7. The thermal transfer ribbon of claim 1 wherein the first coating contains as essential ingredients about 5 to 16% latex, about 5 to 50% sucrose benzoate, about 10 to 50% phenolic resin, and about 2 to 10% leuco dye, all by dry weight.

8. The thermal transfer ribbon of claim 7 wherein the first coating also contains about 0.5 to 1% wetting agent and about 0.1 to 1.1% defoaming agent, both by dry weight.

9. The thermal transfer ribbon of claim 1 wherein the first coating contains as essential ingredients about 5 to 16% latex, about 5 to 50% sucrose benzoate, about 10 to 50% phenolic resin, about 5 to 30% amide wax and about 2 to 10% leuco dye, all by dry weight.

10. The thermal transfer ribbon of claim 9 wherein the first coating also contains about 0.5 to 1% wetting agent and about 0.1 to 1.1% defoaming agent, both by dry weight.

11. A method of making and using a thermal transfer ribbon having a substrate, a first coating on said substrate and a second coating on said first coating, comprising the steps of:

applying said first coating directly onto said substrate, said first coating containing water based ingredients comprising a phenolic resin and a leuco dye which are thermally reactive for creating color images, applying said second coating directly onto said first coating, said second coating containing solvent based ingredients comprising a wax mixture of ethylene vinyl acetate copolymer, paraffin wax and carnauba wax, and an iron oxide dispersed in said wax mixture for enabling transfer and permanent marking of said color images, and heating said thermal transfer ribbon to effect transfer of said color images onto a receiving medium, the heating of said phenolic resin and said leuco dye causing a thermal reaction with each other in the creation of said color images and such heating also thermally activating the wax mixture dispersion of said second coating and such thermal reaction caused by heating of said phenolic resin and said leuco dye assisting the ingredients in said second coating in the transfer of said color images onto said receiving medium.

12. The method of claim 11 wherein said first coating is light in color when applied to said substrate and said images assume a dark color upon heating of said first coating, said color images solidifying and producing intensified images upon transfer to said receiving medium.

13. The method of claim 11 wherein said first coating is light in color when applied to said substrate and said images assume a dark color upon heating of said first coating and upon the reaction of said phenolic resin and said leuco dye, the dark color images being transferred with and assisting the ingredients in said second coating for producing intensified images on said receiving medium.

* * * * *